US008011910B2

(12) United States Patent
O'Brien, II

(10) Patent No.: US 8,011,910 B2
(45) Date of Patent: Sep. 6, 2011

(54) LOW NOISE GEAR SET FOR GEAR PUMP

(75) Inventor: James A. O'Brien, II, La Salle, MI (US)

(73) Assignee: Limo-Reid, Inc., Deerfield, MI (US)

( * ) Notice: Subject to any disclaimer, the term of this patent is extended or adjusted under 35 U.S.C. 154(b) by 895 days.

(21) Appl. No.: 11/685,546

(22) Filed: Mar. 13, 2007

(65) Prior Publication Data

US 2007/0237666 A1 Oct. 11, 2007

Related U.S. Application Data

(63) Continuation-in-part of application No. 11/359,728, filed on Feb. 22, 2006, now Pat. No. 7,281,376, which is a continuation-in-part of application No. 11/101,837, filed on Apr. 8, 2005, now Pat. No. 7,179,070.

(60) Provisional application No. 60/781,775, filed on Mar. 13, 2006.

(51) Int. Cl.

| | |
|---|---|
| ***F01C 21/00*** | (2006.01) |
| ***F03C 2/00*** | (2006.01) |
| ***F03C 4/00*** | (2006.01) |
| ***F04C 18/00*** | (2006.01) |
| ***F04C 2/00*** | (2006.01) |

(52) U.S. Cl. ..... 418/189; 418/190; 418/201.3; 418/206.5

(58) Field of Classification Search ..... 418/189, 418/190, 201.3, 206.1–206.8

See application file for complete search history.

(56) References Cited

U.S. PATENT DOCUMENTS

| | | | | |
|---|---|---|---|---|
| 60,365 | A | 12/1866 | Hardy | |
| 815,522 | A | 3/1906 | Fraser | |
| 2,293,126 | A | 8/1942 | Fersing | |
| 2,462,924 | A | 3/1949 | Ungar | |
| 2,484,789 | A | 10/1949 | Hill et al. | |
| 2,684,636 | A | 7/1954 | Heldenbrand | |
| 2,754,765 | A | 7/1956 | Joy | |
| 2,884,864 | A * | 5/1959 | Bobnar | 418/135 |
| 3,007,418 | A | 11/1961 | Brundage | |
| 3,110,265 | A | 11/1963 | Miller | |
| 3,549,209 | A | 12/1970 | Moericke | |
| 3,588,295 | A | 6/1971 | Burk | |
| 3,805,526 | A | 4/1974 | Charron | |
| 3,827,239 | A | 8/1974 | Ulrich, Jr. | |
| 3,894,606 | A | 7/1975 | Hunck et al. | |
| 3,906,727 | A | 9/1975 | Hull | |

(Continued)

FOREIGN PATENT DOCUMENTS

GB 2265945 A 10/1993

(Continued)

*Primary Examiner* — Theresa Trieu

(74) *Attorney, Agent, or Firm* — Fraser Clemens Martin & Miller LLC; William J. Clemens

(57) ABSTRACT

A low noise gear set for use generally and preferably with a power plant having an engine driving a pump connected to a low pressure fluid source, generating high pressure fluid at an output. The idle gear meshes with the drive gear along two points of the profile of the corresponding gears. The first point being the root of one gear tooth meshing with the tip of the opposite gear tooth creating an initial first contact point and a subsequent second point along the profile when the teeth are disengaging at the first point and engaging at the second point, forming a sealed area, allowing the fluid to hydrostatically escape between the points.

9 Claims, 12 Drawing Sheets

U.S. PATENT DOCUMENTS

| | | | | | |
|---|---|---|---|---|---|
| 4,072,131 | A | | 2/1978 | Pentel | |
| 4,131,171 | A | | 12/1978 | Keyes | |
| 4,196,587 | A | | 4/1980 | Shiber | |
| 4,242,066 | A | | 12/1980 | Hodgson | |
| 4,242,922 | A | | 1/1981 | Baudoin | |
| RE31,067 | E | | 10/1982 | Roberts | |
| 4,426,199 | A | | 1/1984 | Wusthof et al. | |
| 4,484,655 | A | | 11/1984 | Sheppard, Sr. | |
| 4,492,539 | A | | 1/1985 | Specht | |
| 4,493,622 | A | | 1/1985 | Miller | |
| 4,545,748 | A | | 10/1985 | Middlekauf | |
| 4,563,136 | A | | 1/1986 | Gervais et al. | |
| 4,740,142 | A | | 4/1988 | Rohs et al. | |
| 4,812,111 | A | | 3/1989 | Thomas | |
| 4,824,347 | A | | 4/1989 | Diugokecki | |
| 4,902,202 | A | * | 2/1990 | Bowden | 418/189 |
| 5,056,315 | A | | 10/1991 | Jenkins | |
| 5,184,947 | A | | 2/1993 | Coombe | |
| 5,305,721 | A | | 4/1994 | Burtis | |
| 5,306,127 | A | | 4/1994 | Kinney | |
| 5,335,750 | A | | 8/1994 | Geringer et al. | |
| 5,350,286 | A | * | 9/1994 | Kisi et al. | 418/150 |
| 5,476,374 | A | | 12/1995 | Langreck | |
| 5,540,299 | A | | 7/1996 | Tohda et al. | |
| 5,620,315 | A | | 4/1997 | Pfuhler | |
| 5,724,812 | A | | 3/1998 | Baker | |
| 5,784,883 | A | | 7/1998 | Ohkura et al. | |
| 5,907,952 | A | | 6/1999 | Akasaka et al. | |
| 6,006,519 | A | | 12/1999 | Hormell, Jr. | |
| 6,244,839 | B1 | | 6/2001 | Cole et al. | |
| 6,283,735 | B1 | | 9/2001 | Schreiber et al. | |
| 6,361,289 | B1 | * | 3/2002 | Hennes et al. | 418/201.3 |
| 6,553,759 | B2 | | 4/2003 | Matsufuji | |
| 6,758,656 | B2 | | 7/2004 | Maier et al. | |
| 6,862,885 | B1 | | 3/2005 | Mitchell | |
| 6,877,577 | B1 | | 4/2005 | Smith | |
| 6,971,232 | B2 | | 12/2005 | Singh | |
| 2001/0024618 | A1 | | 9/2001 | Winmill | |
| 2003/0116368 | A1 | | 6/2003 | Winkelman et al. | |
| 2005/0044873 | A1 | | 3/2005 | Tamai et al. | |
| 2005/0178115 | A1 | | 8/2005 | Hughey | |
| 2005/0223706 | A1 | | 10/2005 | Mitchell et al. | |
| 2005/0247504 | A1 | | 11/2005 | Gleasman et al. | |

FOREIGN PATENT DOCUMENTS

| | | | | | |
|---|---|---|---|---|---|
| JP | 56151295 | A | * | 11/1981 | 418/189 |
| SU | 400741 | A | | 2/1974 | |

* cited by examiner

LOW NOISE GEAR SET FOR GEAR PUMP

CROSS-REFERENCE TO RELATED APPLICATION

This application is a continuation-in-part of U.S. application Ser. No. 11/359,728 filed on Feb. 22, 2006 that claims priority from the provisional application Ser. No. 60/655,221 filed on Feb. 22, 2005. Application Ser. No. 11/359,728 is a continuation-in-part of U.S. application Ser. No. 11/101,837 filed on Apr. 8, 2005, now U.S. Pat. No. 7,179,070, that claims priority from the provisional application Ser. No. 60/560,897 filed on Apr. 9, 2004.

This application claims the benefit of U.S. provisional application Ser. No. 60/781,775 filed on Mar. 13, 2006.

BACKGROUND OF THE INVENTION

The present invention relates generally to vehicle powertrain systems and, in particular, to a low noise gear pump that reduces gear wear.

Gear pumps and motors are some of the most durable pumps available. The noise that these pumps generate, however, is objectionable for many applications. Controlling this noise source is desirable. Noise level and frequency are affected by the type of gear teeth, the geometry of the gear tooth, the gear tooth surface and the lubrication. Much of the noise is generated by oil that becomes trapped between the gear teeth as they mesh.

In many instances, altering the type of gear teeth used or smoothing the tooth surface is not possible where amending the geometry of the gear tooth may compromise the gear's ability to transmit load. Further, using higher viscosity oils and greases can cut down on noise but may not be well suited for every gear unit.

It is desirable, therefore, to provide a low noise gear pump that additionally reduces gear wear.

SUMMARY OF THE INVENTION

In order to accommodate a quiet seal strategy, the way in which gears presently mesh had to be rethought. Instead of the gears sealing using the sides of the gear profile, the seal is obtained using the tip to the root of the gears as one point and when the next gear tooth engages, the oil may escape hydrostatically between the teeth of the previous meshed gears.

The present invention preferably comprises a low noise gear set for use in any arrangement and is described herein for use with a power plant having an engine driving a pump connected to a low pressure fluid source to generate high pressure fluid at an output; at least one variable displacement pump/motor responsive to said high pressure fluid for generating rotary motion at an output; the displacement pump/motor comprising a drive gear and an idle gear meshing with the drive gear, wherein the idle gear meshes with the drive gear along two points of the profile of said corresponding gears; at least one of two points being the root of one gear tooth meshing with the tip of the opposite gear tooth creating a first mesh point for obtaining a fluid seal from the low pressure fluid source between the root and the tip and a subsequent second point along the profile when the teeth engage, allowing the fluid to hydrostatically escape between the points upon disengaging at the high pressure fluid output.

Preferably, the method for providing a low noise gear pump that reduces gear wear includes the steps of providing a first gear; engaging the first gear with a second gear at a first of two mesh points; wherein a first mesh point is the root of one gear tooth and the tip of the opposite gear tooth and the second mesh point is a point along the side of one gear tooth profile meshing with a point along the side of the opposite gear tooth profile; forming an area for sealing the gear teeth when the gears are engaged at one of the two mesh points; and disengaging at the other of the two mesh points along the profile of the rotating gear teeth, providing a means for fluid to hydrostatically escape.

DESCRIPTION OF THE DRAWINGS

The above, as well as other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1A:
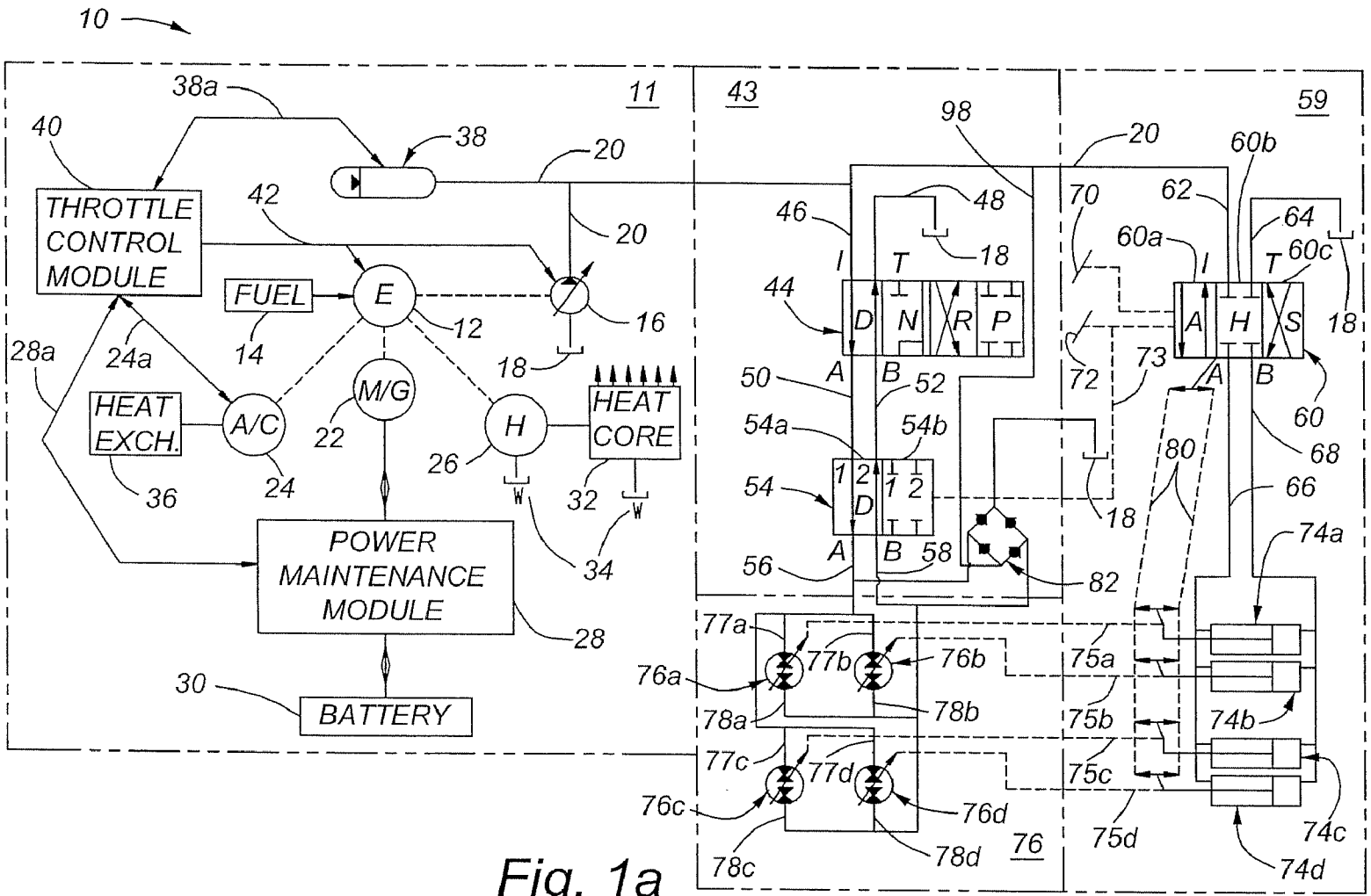
FIG. 1*a* is a schematic view of a hydraulic hybrid powertrain system in accordance with the present invention with a mode select valve in a "Drive" position.

The following patent applications are incorporated herein by reference: U.S. provisional application Ser. No. 60/560,897; U.S. patent application Ser. No. 11/101,837, now U.S. Pat. No. 7,179,070; U.S. provisional application Ser. No. 60/655,221; U.S. application Ser. No. 11/359,728; and U.S. provisional application Ser. No. 60/781,775.

The low noise gear set 300 consists of at least two or more gears, preferably a drive gear 310 rotating in the direction of an arrow 330 and driving an idle gear 312 in the direction of an arrow 332. The idle gear 312 meshes with the drive gear 310 at two points 314, 316 along the corresponding tooth profiles 318, 320 while driving the idle gear 312. As the drive gear 310 is rotated, the gears 310, 312 engage at a first mesh point 314. This first mesh point 314 is preferably formed when the root 326 of one gear tooth, in this case the root 326 of a gear tooth located on the drive gear 310, engages the tip 328 of the opposite gear tooth, in this case the tip 328 of a gear tooth located on the idle gear 312.

Figure 6:
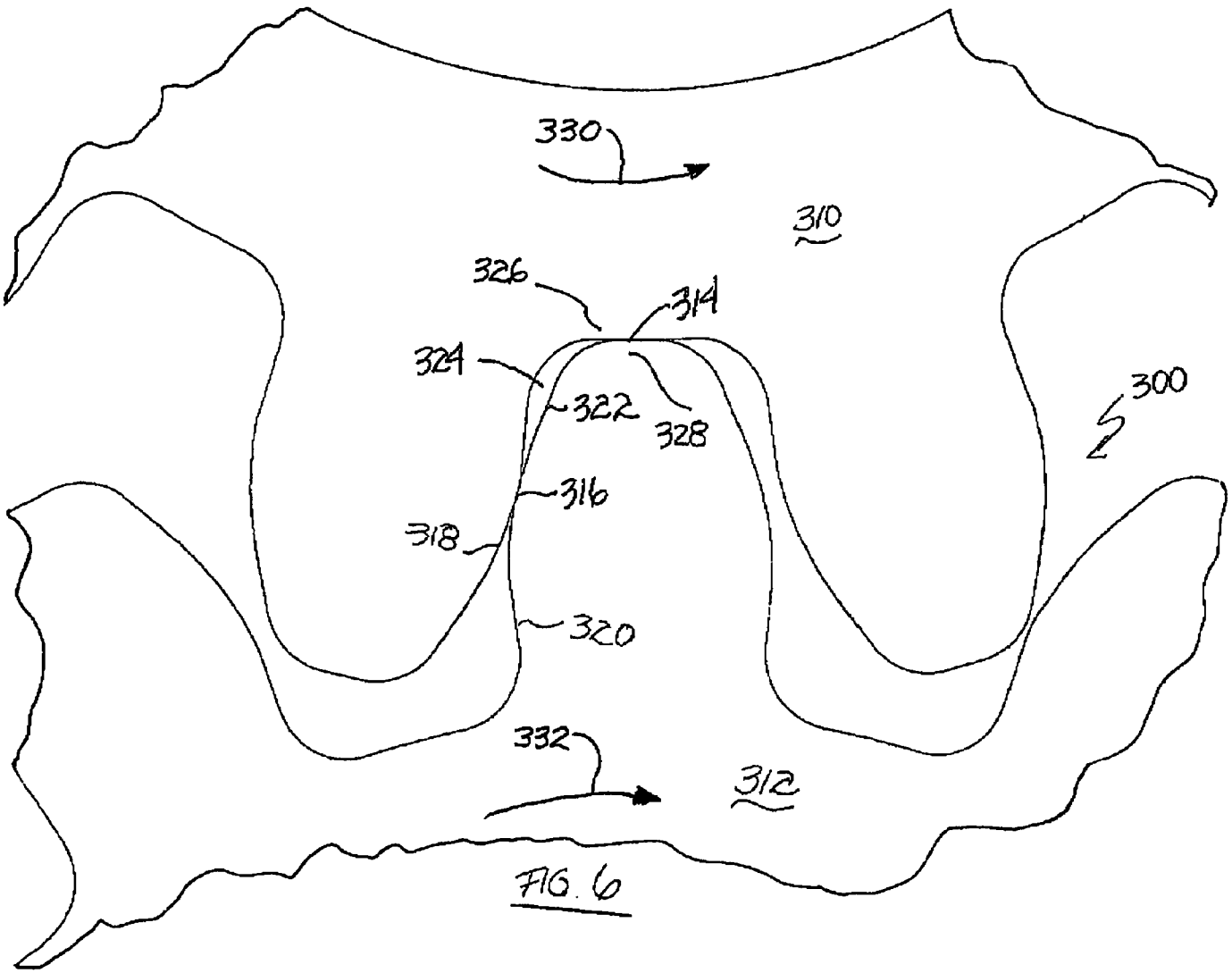
FIG. 6 is an enlarged view of the gear mesh apparatus and method in accordance with the present invention.

Referring now to FIG. 6, a low noise gear set in accordance with the present invention is indicated generally at 300. The low noise gear set 300 may be utilized in a variety of installations where an internal or external gear pump/motor is desired for use with any viscosity fluid, thereby advantageously providing a low noise and reduced wear gear set for use with any setting.

The low noise gear set 300 consists of at least two or more gears, preferably a drive gear 310 and an idle gear 312. The idle gear 312 meshes with the drive gear 310 at two points 314, 316 along the corresponding tooth profiles 318, 320 while driving the idle gear 312. As the drive gear 310 is rotated, the gears 310,312 engage at a first mesh point 314. This first mesh point 314 is preferably formed when the root 326 of one gear tooth, in this case the root 326 of a gear tooth located on the drive gear 310, engages the tip 328 of the opposite gear tooth, in this case the tip 328 of a gear tooth located on the idle gear 312.

As the drive gear 310 continually rotates, a second mesh point 316 is preferably formed along the side of one gear tooth profile 318 of the drive gear 310 and the opposite gear tooth profile 320 of the idle gear 312. A seal 322 is created by the mechanical pressure created by pressurized fluid or gas on one side of a pump 16 as the first mesh point 314 disengages during rotation of the gears and the second mesh point 316 subsequently engages. A small amount of fluid 324, such as oil, is trapped between the drive gear 310 and the idle gear 312 between the seal 322 formed by points 314 and 320. As a result of the seal 322, the pressure of the trapped fluid 324 is forced perpendicular to the center of the gears 310, 312, forcing the fluid 324 out between the gears 310, 312 rather than the gears 310, 312 attempting to compress the fluid 324 between them.

When used with a power plant comprising, such as a hydraulic hybrid powertrain system 10, including a pump/motor 16, a preferred method for providing a low noise gear set 300 for use with a pump 16 while reducing gear wear comprises the steps of:

providing a first gear 310;

engaging the first gear 310 with a second gear 312 at a first mesh point 314, wherein the first mesh point 314 is the root 326 of one gear tooth and the tip 328 of the opposite gear tooth;

engaging the first gear 310 with the second gear 312 at a second mesh point 316, wherein the second mesh point 316 is a point along the side of one gear tooth profile 318 meshing with a point along the side of the opposite gear tooth profile 320;

forming an area for sealing 322 the gear teeth when the gears 310, 312 are engaged at said second mesh point 316 and disengaging from the first mesh point 314; and upon disengaging the gear teeth at the first mesh point 314, providing a means for fluid 324 to hydrostatically escape.

As the drive gear 310 rotates the idle gear 312, the meshing of the gear teeth continually form subsequent first and second mesh points, 314, 316. In this way, while the second mesh point 316 is disengaging, a subsequent first mesh point on the subsequent gear teeth is formed at the root and tip of the corresponding teeth. The rotation of the gears provides a mesh point system along the profile of the gear teeth. The beginning of disengagement of the first mesh point 314 at the beginning of engagement of a second mesh point 316 forms an area for sealing 322. Once the first mesh point 314 disengages, the fluid 324 hydrostatically escapes the sealing area 322.

Referring now to FIG. 1*a*, a hydraulic hybrid powertrain system is indicated generally at 10. The powertrain system 10 may be utilized in a variety of installations, such as, but not limited to, an automotive vehicle, a boat, a submarine, a helicopter, or the like as will be appreciated by those skilled in the art, but for clarity will be referred to as if installed in an automotive vehicle in the following description of the present invention. The powertrain system 10 includes a power plant section 11, a mode selector module 43, a control section 59, and a power delivery section 76.

The power plant section 11 of the powertrain system 10 includes an engine 12 in communication with a fuel source 14. The engine 12 may be a conventional internal combustion engine, a turbine engine, an electric motor powered by a battery, a fuel cell, or the like. The engine 12 selectively provides torque to a preferably variable displacement hydraulic pump/motor 16, which is supplied with a low pressure source 18 of hydraulic fluid on an inlet side thereof and a high pressure conduit 20 on an outlet side thereof. The hydraulic fluid may be a liquid, such as but not limited to water, hydraulic fluid, transmission fluid or the like, or any compressible gas while remaining within the scope of the present invention. The pump/motor 16 is described as such because, depending on the mode of the system 10, the device functions alternately as a pump or a motor, discussed in more detail below.

The power plant section 11 of the system 10 includes a plurality of accessory drives including, but not limited to, a motor generator 22, an air conditioning compressor 24, and a heat pump 26. The motor generator 22 is connected to a power maintenance module 28, which is in turn connected to a battery pack 30. The heat pump 26 is in communication with a heater core 32 and both the heat pump 26 and the heater core 32 are in fluid communication with a cooling water source 34 for the engine 12. The air conditioning compressor 24 is in communication with a heat exchanger 36. The accessory drives 22, 24, and 26 are preferably run by respective electric or hydraulic motors. Alternatively, the accessory drives 22, 24, and 26 are selectively mechanically clutched to the engine 12. An accumulator 38 is in fluid communication with the high pressure conduit 20 on the outlet of the pump/motor 16. The accumulator 38 serves as a reservoir for high pressure hydraulic fluid and maintains high pressure in the system 10, such as by being charged with a high pressure gas or the like (not shown), as will be appreciated by those skilled in the art.

A throttle control module 40 receives an input signal from the air conditioning compressor 24 via a signal on a line 24*a*, the power maintenance module 28 via a signal on a line 28*a*, and the accumulator 38 via a signal on a line 38*a*. Based on the input signals on the lines 24*a*, 28*a*, and 38*a*, the throttle control module 40 provides an output signal on a line 42 to control either or both of the engine 12 and the pump/motor 16, discussed in more detail below. The signals on the lines 24*a*, 28*a*, 38*a*, and 42 may be electronic signals or mechanical feedback between the various components and the throttle control module 40. The throttle control module 40 can be any suitable mechanical or electrical device operable to control the operation of the engine 12 and the pump/motor 16 based on one or more inputs.

The mode selector module 43 includes a mode select valve 44 that is in fluid communication with the high pressure conduit 20 by a high pressure inlet conduit 46. The mode select valve 44 is preferably connected to a transmission-like shift lever (not shown) or the like for selectively moving the valve 44 into a one of a "D" or drive position (best seen in FIG. 1*a*), a "N" or neutral position (best seen in FIG. 1*b*), a "R" or reverse position (best seen in FIG. 1*c*), and a "P" or park position (best seen in FIG. 1*d*). The mode select valve 44 includes a low pressure inlet conduit 48 connected thereto adjacent the high pressure inlet conduit 46. The mode select valve 44 also includes a high pressure outlet conduit 50 and a low pressure outlet conduit 52 connected thereto and on an opposing side of the mode select valve 44. Each position P, R, N, D of the mode select valve 44 selectively aligns the internal portion of the position with the conduits 46, 48, 50, and 52 and controls the direction of hydraulic fluid flow in the system 10, discussed in more detail below. While described as "inlet" and "outlet" above during operation each of the conduits 46, 48, 50, and 52 may function as an inlet or an outlet depending on the operating condition of the system 10, discussed in more detail below.

The conduits 50 and 52, in turn, are connected to a brake override device 54. The brake override device 54 also includes a high pressure outlet conduit 56 and a low pressure outlet conduit 58 connected thereto on an opposing side of the brake override device 54. The brake override device 54 has a first or normal position 54*a* and a second or override position 54*b*, discussed in more detail below.

Figure 2:
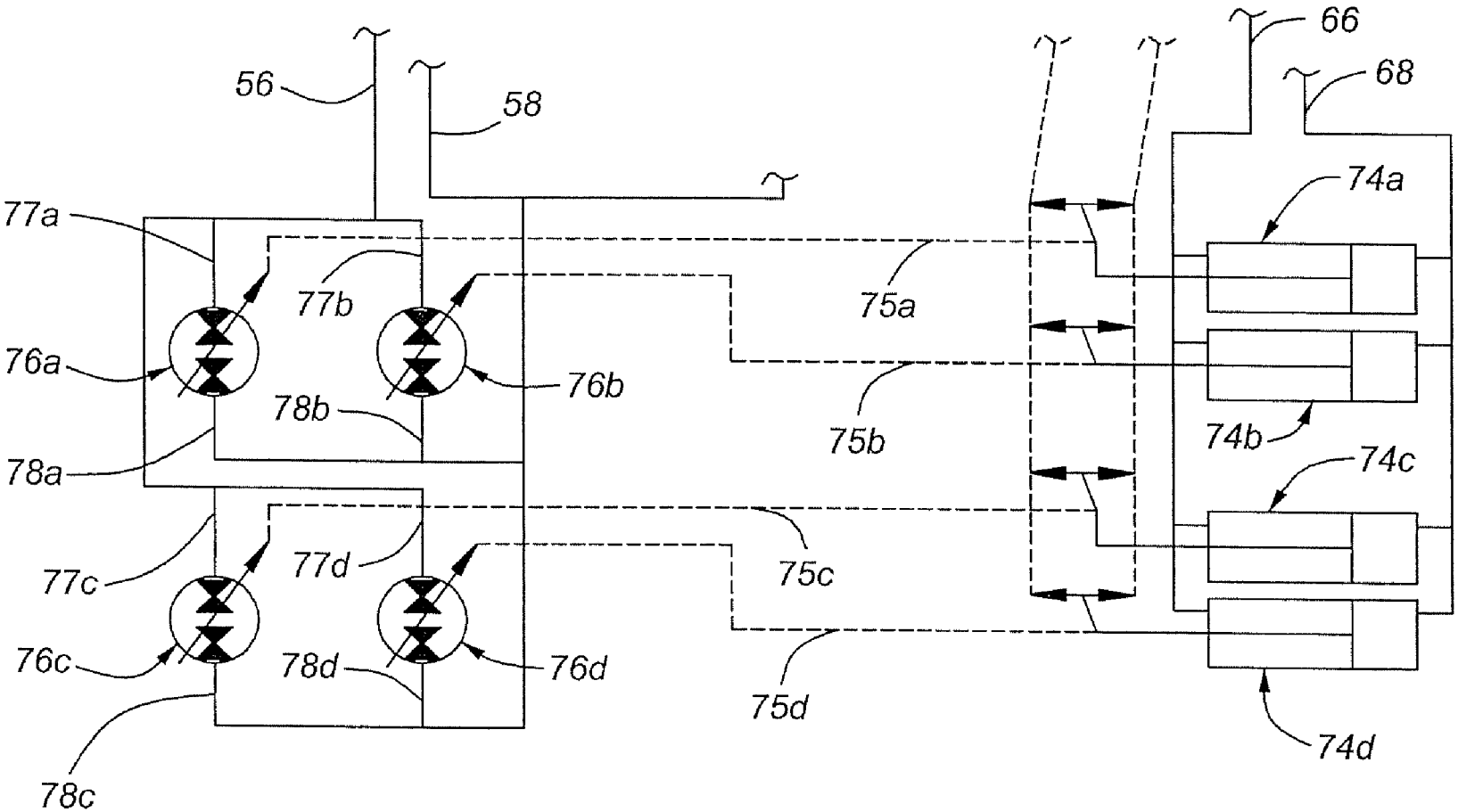
FIG. 2 is a schematic view in an enlarged scale of the drive motors and displacement control devices shown in FIGS. 1*a*-1*d;*

The control section 59 includes a displacement control valve 60 that is in fluid communication with the high pressure conduit 20 by a high pressure inlet conduit 62. The displacement control valve 60 includes a low pressure inlet conduit 64 connected thereto adjacent the high pressure inlet conduit 62. The displacement control valve 60 also includes a high pressure outlet conduit 66 and a low pressure outlet conduit 68 connected thereto on an opposing side of the displacement control valve 60. The displacement control valve 60 is a floating positional valve and includes an accelerator 70 and a brake 72 connected thereto for directing flow from the displacement control valve 60 to a plurality of cylinders 74*a*, 74*b*, 74*c*, and 74*d*. The accelerator 70 and brake 72 are preferably mechanically connected to a respective accelerator pedal and a brake pedal (not shown). The brake 72 is connected to the brake override device 54 via a connector 73. The displacement control valve 60 has a first or acceleration position 60*a*, a second or hold position 60*b*, and a third or deceleration position 66*c*. Each position 60*a*, 60*b*, and 60*c* of the displacement control valve 60 selectively aligns the internal portion of each position 60*a*, 60*b*, and 60*c* with the conduits 62, 64, 66, and 68 and controls the direction of hydraulic fluid flow to the cylinders 74*a*, 74*b*, 74*c*, and 74*d*, best seen in FIG. 2.

Each of the cylinders 74*a*, 74*b*, 74*c*, and 74*d* is mechanically connected via a connector 75*a*, 75*b*, 75*c*, and 75*d*, to a respective and drive or traction motor 76*a*, 76*b*, 76*c*, and 76*d* (in the power delivery section 76), on each of the vehicle wheels. The motors 76*a*-76*d* are preferably variable displacement motors. The position of the connectors 75*a*-75*d* determines the displacement of the motors 76*a*-76*d*, as will be appreciated by those skilled in the art such as by a connection to a swash plate or the like. The high pressure outlet conduit 66 is in fluid communication with one side of a piston (not shown) in each of the cylinders 74*a*-74*d* and the low pressure outlet conduit 68 is in fluid communication with an opposite side of the piston in the cylinders 74*a*-74*d*. While the system 10 is illustrated with a plurality of traction motors 76*a*, 76*b*, 76*c*, and 76*d*, those skilled in the art will appreciate that as few as one motor may be utilized while remaining within the scope of the present invention. For example, in a single motor installation in an automotive vehicle, the output of the single motor is connected to a differential gear which is in turn mechanically connected to a pair of drive wheels. Each of the traction motors 76*a*, 76*b*, 76*c*, and 76*d* have an upper port 77*a*, 77*b*, 77*c*, and 77*d* and a lower port 78*a*, 78*b*, 78*c*, and 78*d*. The direction of the fluid flow through the upper ports 77*a*-77*d* and the lower ports 78*a*-78*d* determines the direction of the motors 76*a*-76*d*. A feedback connector 80 extends between the displacement control valve 60 and the pistons of the cylinders 74*a*-74*d*.

Figure 3:
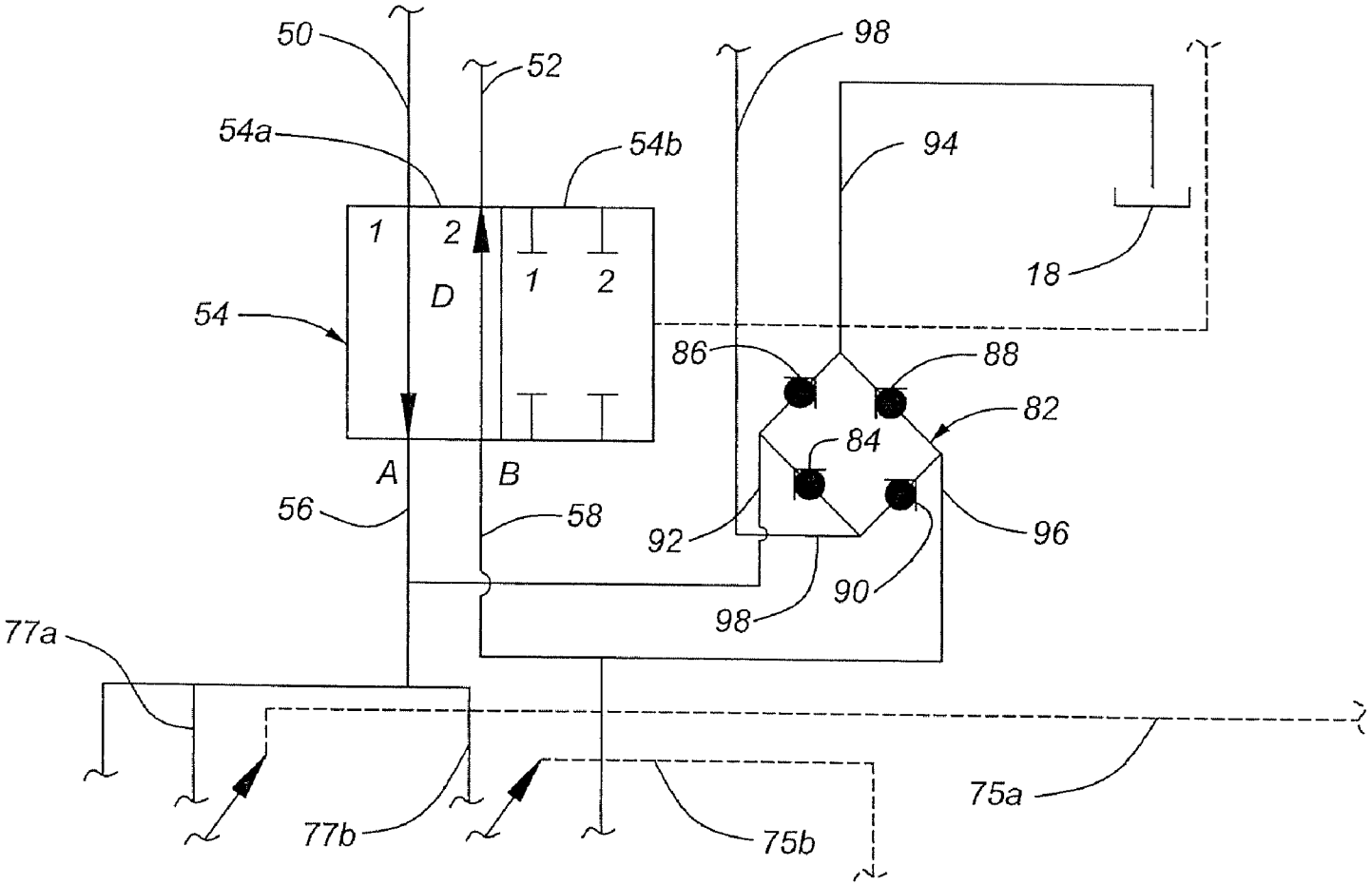
FIG. 3 is a schematic view in an enlarged scale of the brake override device and check valve bridge circuit shown in FIGS. 1*a*-1*d;*

A check valve bridge circuit 82 includes a plurality of check valves 84, 86, 88, and 90 and is arranged in a manner similar to a full-wave bridge rectifier, best seen in FIG. 3. A conduit 92 is in fluid communication with an inlet of the check valve 84 and an outlet of the check valve 86. The conduit 92 is also in fluid communication with the high pressure outlet conduit 56. A conduit 94 is in fluid communication with an inlet of the check valve 86 and an inlet of the check valve 88. The conduit 94 is also in fluid communication with the low pressure source of hydraulic fluid 18. A conduit 96 is in fluid communication with an outlet of the check valve 88 and an inlet of the check valve 90. The conduit 96 is also in fluid communication with the low pressure outlet conduit 56. A conduit 98 is in fluid communication with an outlet of the check valve 84 and an outlet of the check valve 90. The conduit 98 is also in fluid communication with the high pressure conduit 20.

Figure 4:
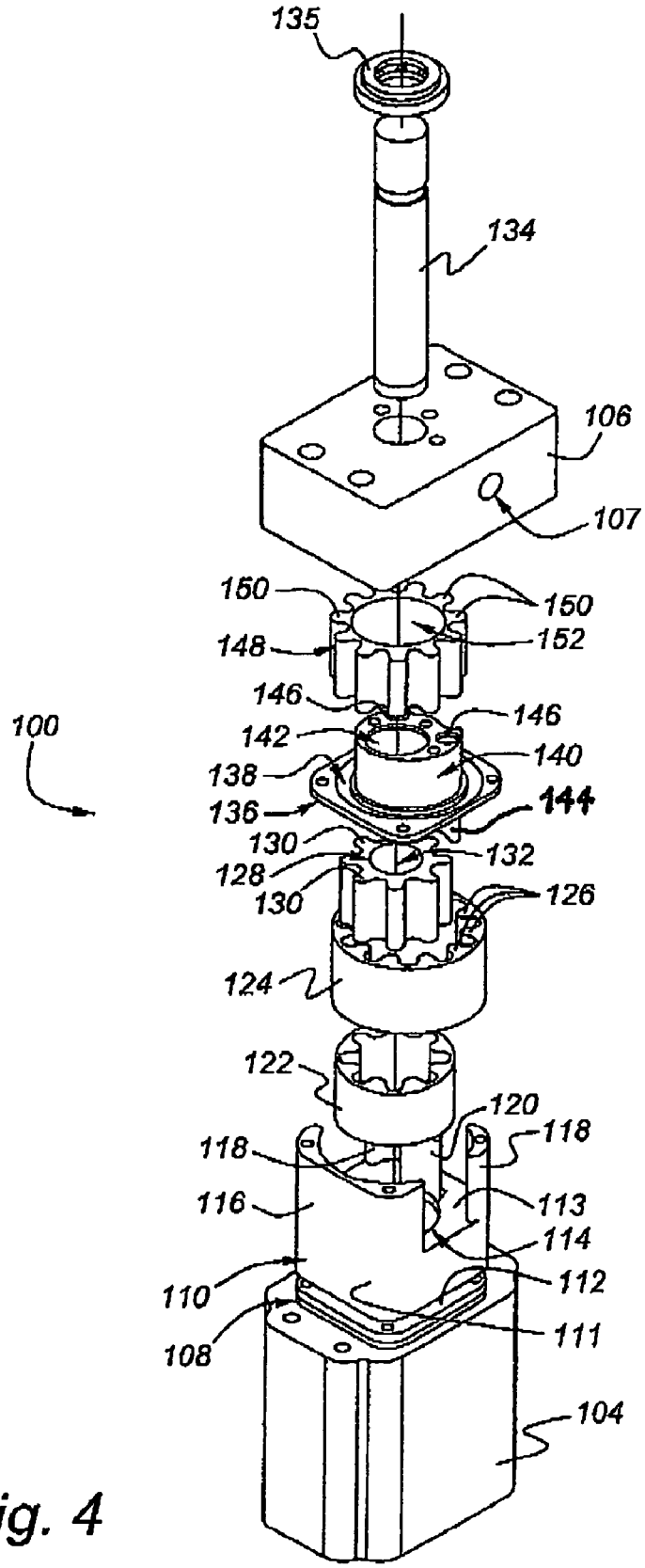
FIG. 4 is an exploded perspective view of an internal gear pump/motor in accordance with the present invention and FIG. 4A is a partial cross sectional perspective view of the assembled internal gear pump/motor of FIG. 4.
Figure 4A:
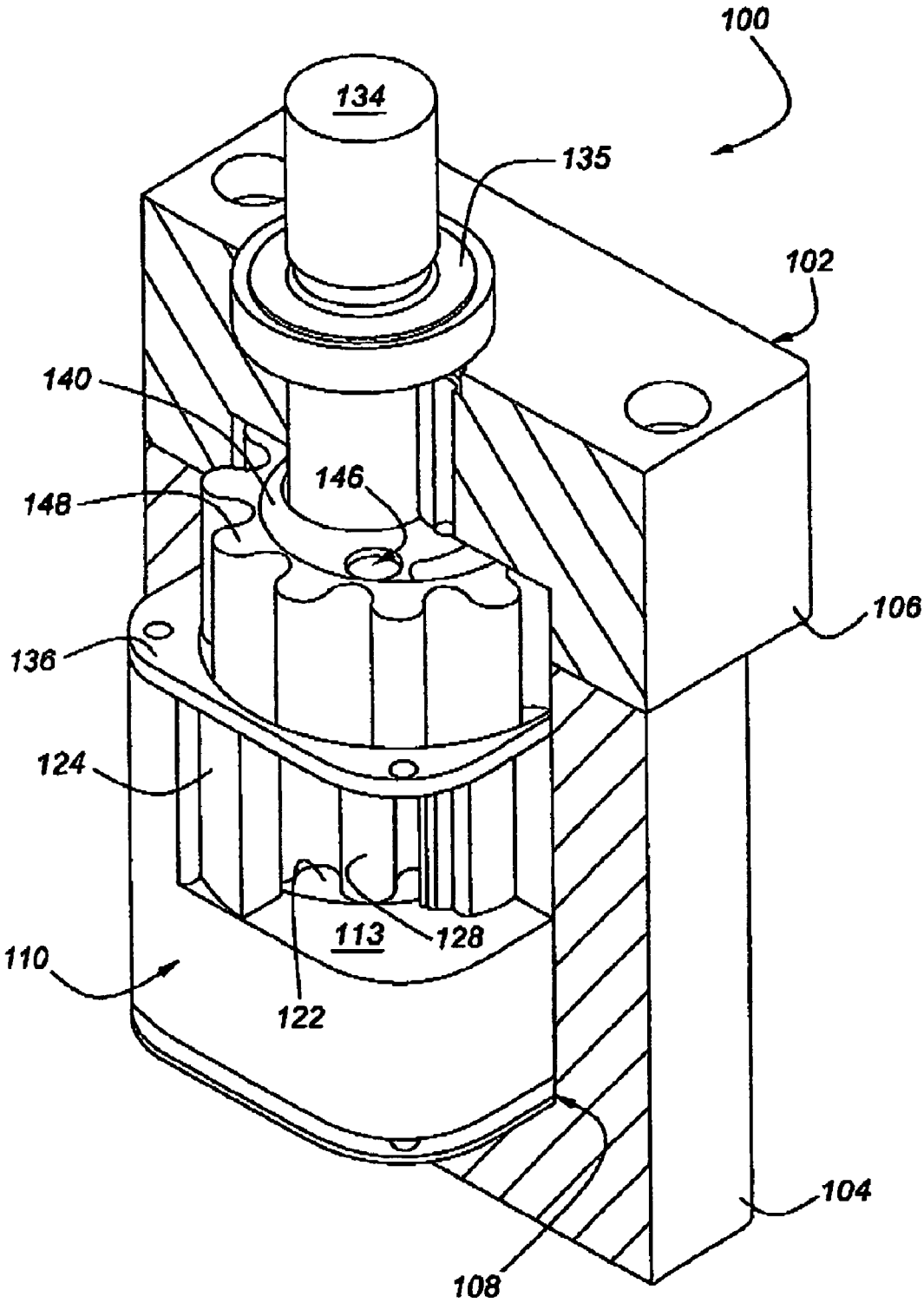

Referring now to FIGS. 4 and 4A, an internal gear apparatus in accordance with the present invention is indicated generally at 100. The apparatus 100 may be configured to operate as a motor or as a pump as will be appreciated by those skilled in the art, but will be referred to as a motor in the following description of the present invention. The internal gear motor 100 includes a hollow housing 102 having a base portion 104 and an end cap 106. The base portion 104 defines a recess or cavity 108 therein that is sized to receive a first mandrel 110 and a first piston member 112. The end cap 106 includes at least two ports 107 (only one is shown) that each extend between an internal and an external surface thereof, preferably on opposite sides of the end cap 106. One of the ports 107 is connected to a high pressure segment of a fluid system such as the high pressure conduit 20 of FIGS. 1*a*-1*e*, and another of the ports 107 is connected to a return line or fluid source such as the fluid source 18 of FIGS. 1*a*-1*e*.

The first mandrel 110 defines an aperture 114 extending through a base portion 111 thereof and includes a first outer flange 116 and a plurality of spaced apart second outer flanges 118 extending upwardly from an upper surface 113 of the base portion 111. An inner flange 120 extends upwardly from the base portion 111 of the first mandrel 110 and is located adjacent the aperture 114. The first outer flange 116 is located adjacent the aperture 114. The second outer flanges 118 are spaced apart from both the aperture 114 and the inner flange 120. A first seal bushing 122 is sized to rotatably fit in the aperture 114 and is preferably substantially equal in height to the base portion 111 of the first mandrel 110 such that when the bushing 122 is placed in the aperture 114, an upper surface of the bushing 122 is substantially flush with the upper surface 113 of the base portion 111.

An external gear 124 that is substantially circular in cross section is adapted to be placed atop the upper surface 113 of the base portion 111 wherein a curved outer surface of the gear 124 is adjacent the respective curved inner surfaces of the outer flanges 116 and 118. The external gear 124 includes a plurality of teeth 126 formed on an inner surface thereof. When placed on the upper surface 113, the gear 124 is fixed axially between the outer flanges 118 and the inner flange 120.

An internal gear 128 that is substantially circular in cross section includes a plurality of teeth 130 formed on an outer surface thereof and defines an aperture 132 extending there through. The teeth 130 are operable to mesh with the teeth 126 formed on the inner surface of the external gear 124. A lower surface of the gear 128 extends into and rotates with the bushing 122, wherein the teeth 130 cooperate with corresponding teeth on the bushing 122 when the motor 100 is assembled and operated, as discussed in more detail below. The respective outer surfaces of the teeth 130 of the internal gear 128 are adjacent the inner surface of the inner flange 120. The aperture 132 is adapted to receive a free end of a drive or output shaft 134 when the motor 100 is assembled. The internal gear 128 is fixed on the shaft 134. The drive shaft 134 is rotatably supported in the end cap 106 by a bearing 135, such as a ball bearing, a roller bearing or the like. The free end of the drive shaft 134 extends a predetermined distance beyond the upper surface of the end cap 106 and acts as an output shaft for the motor 100.

A second piston member 136 defines an aperture 138 on an interior portion thereof and is adapted to be mounted on respective upper surfaces of the outer flanges 116 and 118 of the first mandrel 110. The second piston 136 and the first piston 112, therefore, are mounted on the upper surface and the lower surface, respectively of the lower mandrel 110.

A second mandrel 140 is adapted to be disposed in the aperture 138 of the second piston member 136 and defines an aperture 142 on an interior portion thereof for receiving the drive shaft 134. The second mandrel 140 includes a downwardly extending flange 144 that cooperates with the upwardly extending inner flange 120 of the first mandrel 110 when the motor 100 is assembled. The upper mandrel 140 includes a pair of bores 146 extending there through for fluid communication with the gears 122 and 124 during operation of the motor 100.

A second seal bushing 148 includes a plurality of teeth 150 formed on an exterior surface thereof and defines an aperture 152 extending therethrough. The second seal bushing 148 is adapted to receive the upper mandrel 140 in the aperture 152 and be received in the external gear 124 and rotates therewith, wherein the teeth 126 cooperate with the teeth 150 on the bushing 148 when the motor 100 is assembled and operated, as discussed in more detail below.

When the motor 100 is assembled, the first mandrel 110 and the first piston 112 are placed in the base portion 104 of the housing 102, the first seal bushing 122 is placed in the mandrel 110, and the external gear 124 is placed on the mandrel 110. The internal gear 132 and the second mandrel 138 are mounted on the drive shaft 134 and assembled such that the respective teeth 126 and 130 of the gears 132 and 124 rotatably mesh and the internal gear 132 engages with the first seal bushing 122. The second piston 136 is attached to the upper surface of the mandrel 110, and the second seal bushing 148 is placed on the second mandrel 138 and engages with the external gear 124. The downwardly extending flange 144 cooperates with the upwardly extending inner flange 120 to divide the interior of the external gear into an inlet chamber and discharge chamber of the motor 100 and the upper end cap 106 is attached to the base portion 104 to enclose the housing 102. The flanges 120 and 144 extend radially between the teeth 126 and the teeth 130 to form the inlet chamber on one side of the flanges and the discharge chamber on the other side of the flanges.

In operation, the shaft 134 is connected to a load (not shown), such as a wheel of a vehicle or the like. Pressured fluid is introduced from the fluid system such as from the high pressure conduit 20 of FIGS. 1*a*-1*e*, through one of the ports 107, is routed to the inlet chamber side of the gears 124 and 128 through the bores 146, acts against the meshing teeth 126 and 130 to rotate the gears and the shaft, flows between the teeth to the discharge chamber and is discharged through the other the bores 146 to the other of the ports 107. The first seal bushing 122 provides a rotating seal between the internal gear 128 and the first mandrel 110 and the second seal bushing 148 provides a rotating seal between the external gear 124 and the second mandrel 140 to ensure the integrity of the inlet and discharge chambers. The motor 100 in accordance with the present invention requires only the seals 122 and 148 to maintain a fluid seal and allow for efficient operation of the motor 100.

The normal or default spatial relationship between the teeth 126 and 130 of the gears 124 and 128 is such that the teeth 126 and 130 engage substantially all of the axial area of the teeth. In such a relationship, the motor 100 produces its maximum volume flow or maximum output. The motor 100 in accordance with the present invention may advantageously vary from its maximum displacement because the gear 124 is axially movable along the shaft 134. When the gear 124 moves towards the first mandrel 110, less of the axial area of the teeth 126 and 130 engage, which reduces the volume flow or displacement of the motor 100.

When the unit 100 is configured as a motor, an external source of pressure, such as hydraulic fluid from an external hydraulic pump, compressed air from an air compressor or the like, provides a volume flow to the ports 107 to spin the gears 124 and 128 and produce an output torque on the shaft 134. As the pressure is varied, the gear 124 will move along the axis of the shaft 134 in order to vary the output horsepower of the motor 100. The motor 100 may be advantageously utilized to control output rpm under widely changing output loads including, but not limited to automotive vehicles, turrets, large machinery, earth movers, large well drills, ships, farm equipment, or the like.

When the unit 100 is configured as a pump and the prime mover, such as the engine 12 of FIGS. 1*a*-1*e*, rotates the shaft 134 at a lower speed or with a lower torque, the pump 100 will react to the reduced input speed or input torque by varying its output based on the internal pressures in the pump housing 102 (FIG. 4A). In this condition, the output port 107 will create a higher back pressure in the discharge chamber, and the gear 124 will move along the axis of the shaft 134 to a point along the axis where the gear 124 is at or near equilibrium to continue operation. The pump 100, therefore, can vary from a maximum output or displacement where the gear 124 is substantially adjacent the upper mandrel 140 to a minimum displacement where the gear 124 is substantially adjacent the lower mandrel 110.

Figure 5:
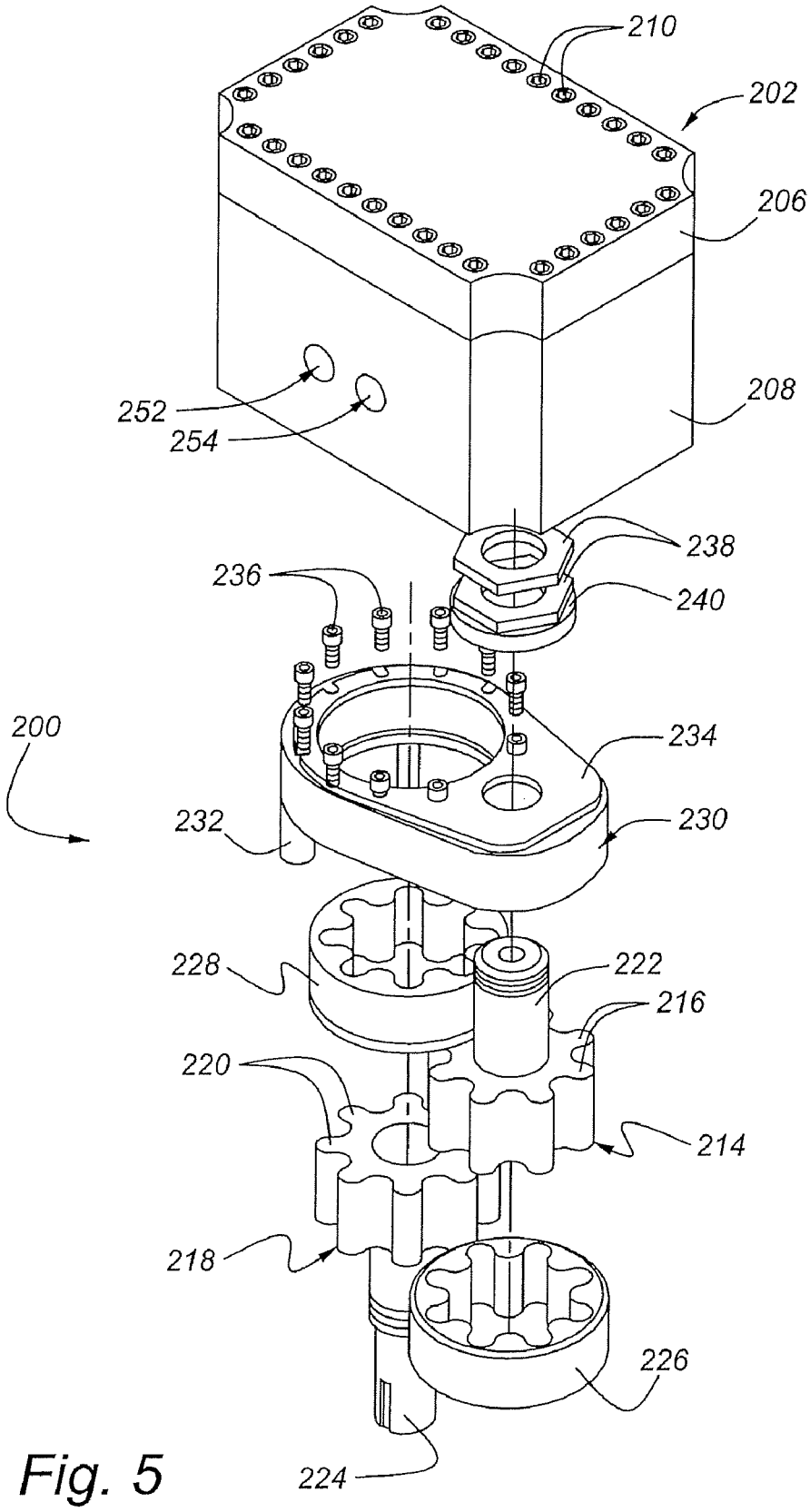
FIG. 5 is a partial exploded perspective view of an external gear pump/motor in accordance with the present invention and FIG. 5A is an exploded partial cross sectional perspective view of the external gear pump/motor of FIG. 5.
Figure 5A:
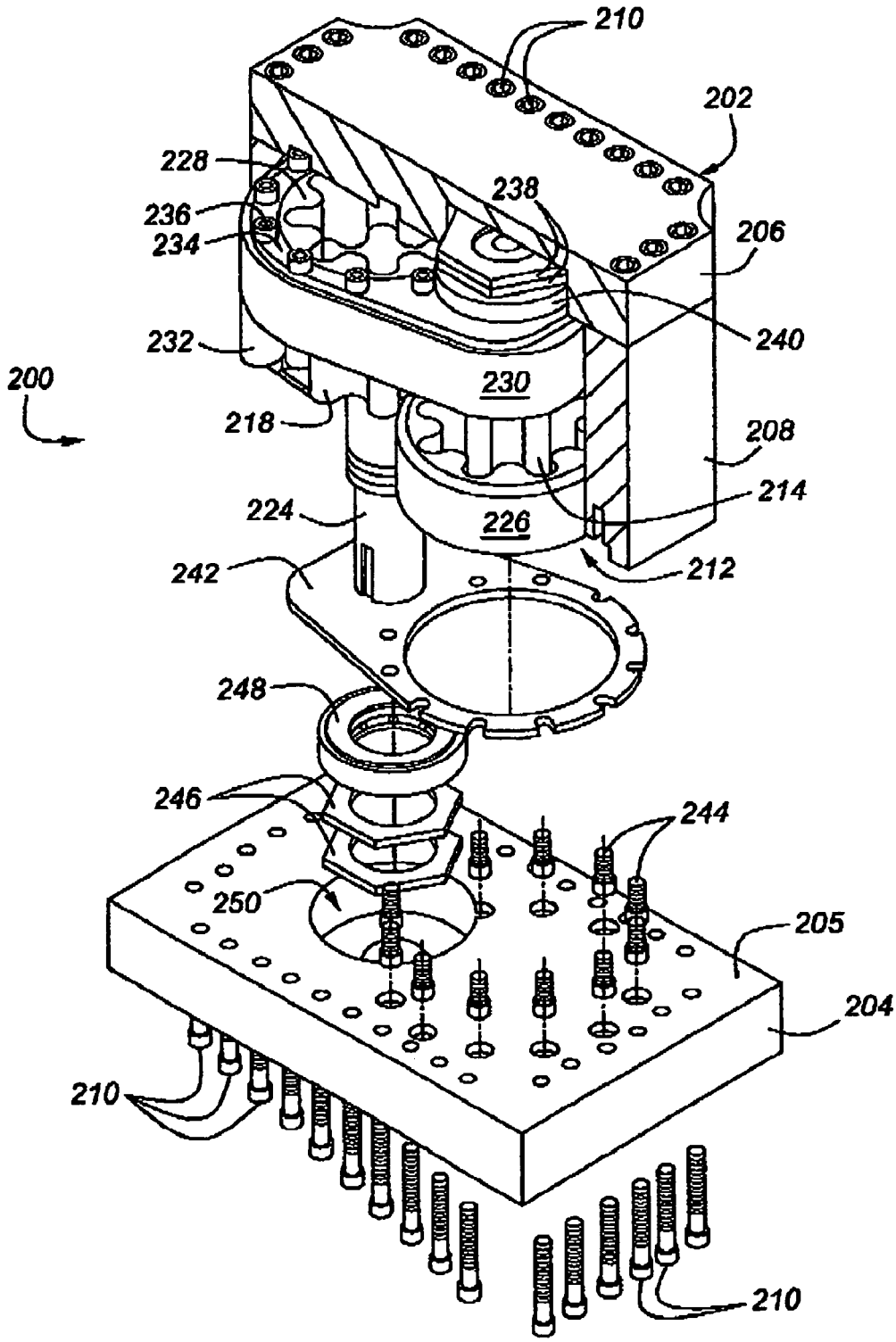

Referring now to FIGS. 5 and 5A, an external gear apparatus in accordance with the present invention is indicated generally at 200. The apparatus 200 may be configured to operate as a pump or a motor as will be appreciated by those skilled in the art, but will be referred to as a pump in order to simplify the description of the present invention. The external gear pump 200 includes a hollow housing 202 having a first end cap 204 and a second end cap 206 connected by a body portion 208. Preferably, the first end cap 204 and the second end cap 206 are attached to the body portion 208 by a plurality of fasteners 210, such as high strength bolts or the like. The body portion 208 defines a recess 212 therein.

A first gear 214 having a plurality of teeth 216 formed on an external surface thereof and a second gear 218 having a plurality of teeth 220 formed on an external surface thereof are adapted to be disposed in the recess 212 of the housing 202. The teeth 216 and 220 of the respective gears 214 and 218 are operable to rotatably mesh in the recess or pump cavity 212 during operation of the pump 200. The first gear 214 has a shaft 222 extending therefrom and the second gear 218 has a stepped shaft 224 extending therefrom. The first gear 214 is fixed on the shaft 222 and the second gear 218 is fixed on the shaft 224. The shafts 222 and 224 extend in opposite axial directions and the shaft 224 is greater in length than the shaft 222. A first seal sleeve 226 having internal teeth receives the first gear 214 and a second seal sleeve 228 having internal teeth receives an end of the second gear 218.

A plate fitting 230 includes a flange 232 extending downwardly therefrom and is attached to a first thrust plate 234 on a planar upper surface thereof. Preferably, the thrust plate 234 is attached to the fitting 230 by a plurality of fasteners 236, such as high strength bolts or the like. A free end of the shaft 222 extends through an opening formed in the fitting 230 and the thrust plate 234. The free end of the shaft 222 is rotatably secured in the fitting 230 and the thrust plate 234 by a pair of nuts 238 and is rotatably supported by a bearing 240, such as a ball bearing, a roller bearing or the like. The second seal sleeve 228 is operable to be received in a recess in the fitting 230 adjacent the flange 232. When the shaft 222 is mounted in the fitting 230 and the thrust plate 234, the gear 214 and the fitting 230 are movable axially with respect to the housing 202.

A second thrust plate 242 is attached to an upper surface 205 of the first end cap 204 by a plurality of fasteners 244, such as high strength bolts or the like. The plate 242 includes an aperture for receiving a free end of the shaft 224 and a larger aperture for receiving and locating the first seal sleeve 226 adjacent the upper surface of the first end cap 204. The free end of the shaft 224 extends through the aperture in the plate 242, threadably engages a pair of nuts 246 at the step and is rotatably supported by a bearing 248, such as a ball bearing, a roller bearing or the like. The bearing 248 is preferably disposed in a cavity 250 formed in the upper surface 205 of the first end cap 204 while the nuts 246 attach the shaft 224 to the end cap on a lower surface opposite the upper surface 205. The free end of the shaft 224 extends a predetermined distance beyond the lower surface of the end cap 204 and acts as a drive shaft or output shaft for the pump 200.

The body portion 208 defines a first port 252 and a second port 254 that each extend between an internal and an external surface thereof. One of the ports 252 and 254 is connected to a low pressure segment of a fluid system such as the hydraulic fluid source 18 of FIGS. 1*a*-1*e* or the like, and another of the ports 252 and 254 is connected to a high pressure or pressurized segment of a fluid system such as the high pressure conduit 20 of FIGS. 1*a*-1*e*.

In operation, the shaft 224 is connected to a prime mover, such as the engine 12 of FIGS. 1*a*-1*e* or the like. When the prime mover rotates the shaft 224, the gear 218 rotates and causes the gear 214 to rotate. Fluid is introduced from the fluid system through one of the ports 252 or 254, is trapped between the meshing teeth 216 and 220 as is well known in the art and is discharged through the other of the ports 252 or 254. Suitable passages are formed in the housing 202 to ensure that the fluid is routed correctly during operation of the pump 200. The first seal sleeve 226 provides a rotating seal between the first gear 214 and the upper surface 205 and the second seal sleeve 228 provides a rotating seal between the second gear 218 and the fitting 230 to ensure the integrity of the pump cavity 212. The pump 200 in accordance with the present invention requires only the seal sleeves 226 and 228 to maintain a seal and allow for efficient operation of the pump 200.

The normal or default spatial relationship between the teeth 216 and 220 of the gears 214 and 218 is such that the teeth 216 and 220 engage substantially all of the axial area of the teeth. In such a relationship, the pump 200 produces its maximum volume flow or maximum displacement. The pump 200 in accordance with the present invention may advantageously vary from its maximum displacement because the first gear 214 is axially movable. When the first gear 214 moves towards the lower thrust plate 242, less of the axial area of the teeth 216 and 220 engage, which reduces the volume flow or displacement of the pump 200. Typically, this will occur when the prime mover rotates the shaft 224 at a lower speed or with a lower torque and the pump 200 will react to the reduced input speed or input torque by varying its output based on the internal pressures in the pump housing 202. In this condition, the output port 252 or 254 will create a higher back pressure in the recess 212, and the first gear 214 together with the fitting 230 will move along the axis of the shaft 224 to a point along the axis where the gear 214 is at or near equilibrium to continue operation. The pump 200, therefore, can vary from a maximum output or displacement where the gear 214 is substantially adjacent the the gear 218 to a minimum displacement where the gear 214 is substantially adjacent the lower thrust plate 242.

When the apparatus 200 is configured as a motor, an external source of pressure, such as hydraulic fluid from an external hydraulic pump, compressed air from an air compressor or the like, provides a volume flow to the ports 252 and 254 to spin the gears 214 and 218 and produce an output torque on the shaft 224. As the pressure is varied, the first gear 214 will move along the axis of the shaft 224 in order to vary the output horsepower of the motor 200. The motor 200 may be advantageously utilized to control output rpm under widely changing output loads including, but not limited to automotive vehicles, turrets, large machinery, earth movers, large well drills, ships, farm equipment, or the like.

In operation of the system 10, the engine 12 is started and supplies torque to the pump/motor 16, which in turn supplies pressurized hydraulic fluid to the high pressure conduit 20. The accumulator 38 ensures that the hydraulic pressure within the conduit 20 remains relatively stable and provides energy storage in a manner well known to those skilled in the art. The pressure in the conduit 20 is transmitted to the conduits 46, 62, and 98.

Referring to FIG. 1*a*, when the mode select valve 44 is in the D or drive position and the brake override device 54 is in the 54*a* position, hydraulic fluid will flow through the conduit 46, through the mode select valve 44 and out the conduit 50 in the direction shown by the arrow in the D position, through the brake override device 54 and out the conduit 56 in the direction shown by the arrow in the 54*a* position, and to the respective upper ports 77*a*-77*d* of the motors 76*a*-76*d*, through the motors 76*a*-76*d* and to the respective lower ports 78*a*-78*d*, dropping in pressure and providing an output torque in a forward direction for each of the motors 76*a*-76*d* in a manner known to those skilled in the art. The lower pressure hydraulic fluid in the lower ports 78*a*-78*d* travels through the conduit 58, through the brake override device and out the conduit 52 in the direction shown by the arrow in the 54*a* position, and through the mode select valve 44 and out the conduit 48 in the direction shown by the arrow in the D position to the hydraulic fluid source 18.

Figure 1B:
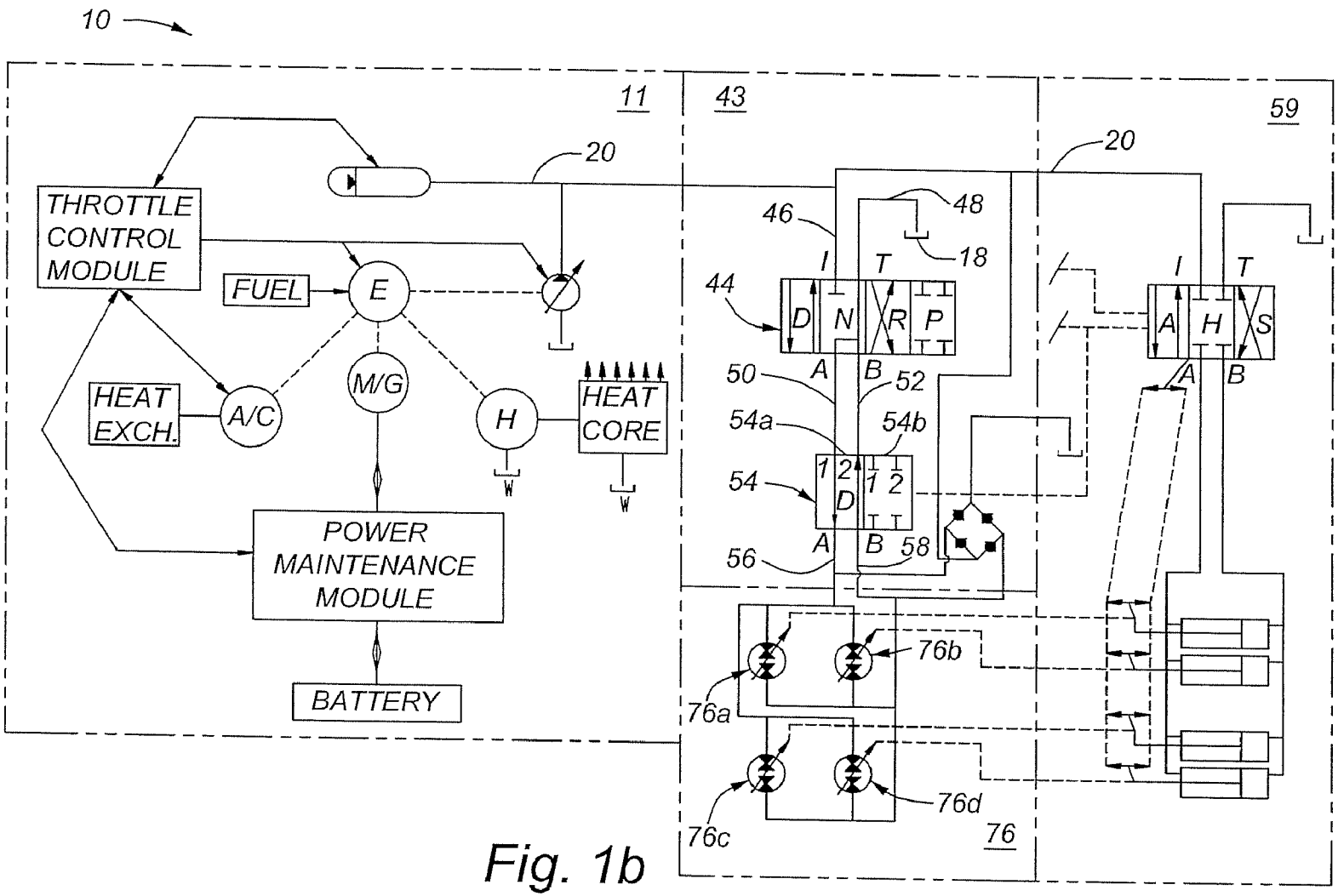
FIG. 1*b* is a view of the hydraulic hybrid powertrain system of FIG. 1*a* with the mode select valve in a "Neutral" position.

Referring to FIG. 1*b*, when the mode select valve 44 is in the N or neutral position, and the brake override device 54 is in the 54*a* position, hydraulic fluid will flow through the conduit 46 but will be prevented from flowing through the mode select valve 44 by the cap adjacent the conduit 46 in the N position. The outlet conduits 50 and 52 are in fluid communication with the lower pressure hydraulic fluid in the conduit 48 and, therefore, there is no fluid flow through the brake override device 54 or to the motors 76*a*-76*d*, as the pressure in the conduits 50 and 56 will balance with the pressure in the conduits 52 and 58. When the in N position, oil from the reservoir 18 is available to flow through to the motors 76*a*-76*d* should any of the motors 76*a*-76*d* require oil flow.

Figure 1C:
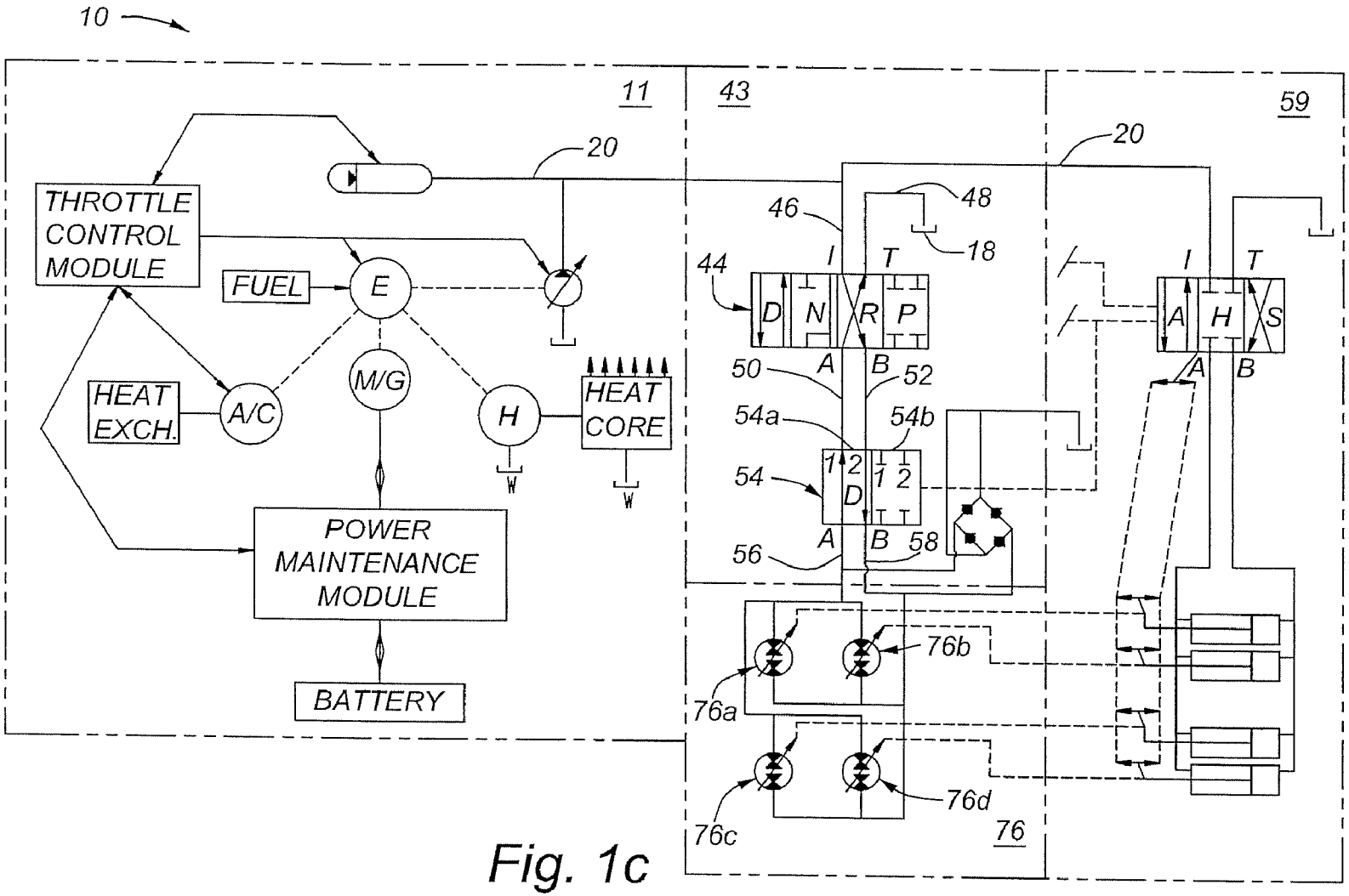
FIG. 1*c* is a view of the hydraulic hybrid powertrain system of FIG. 1*a* with the mode select valve in a "Reverse" position.

Referring to FIG. 1*c*, when the mode select valve 44 is in the R or reverse position, and the brake override device 54 is in the 54*a* position, hydraulic fluid will flow through the conduit 46, through the mode select valve 44 and out the conduit 52 in the direction shown by the arrow in the R position, through the brake override device 54 and out the conduit 58 in the direction shown by the arrow in the 54*a* position, and to the respective lower ports 78*a*-78*d* of the motors 76*a*-76*d*, through the motors 76*a*-76*d* and to the respective upper ports 77*a*-77*d*, dropping in pressure and providing an output torque in a reverse direction for each of the motors 76*a*-76*d* in a manner known to those skilled in the art. The lower pressure hydraulic fluid in the lower ports 77*a*-77*d* travels through the conduit 56, through the brake override device and out the conduit 50 in the direction shown by the arrow in the 54*a* position, and through the mode select valve 44 and out the conduit 48 in the direction shown by the arrow in the D position to the hydraulic fluid source 18.

Figure 1D:
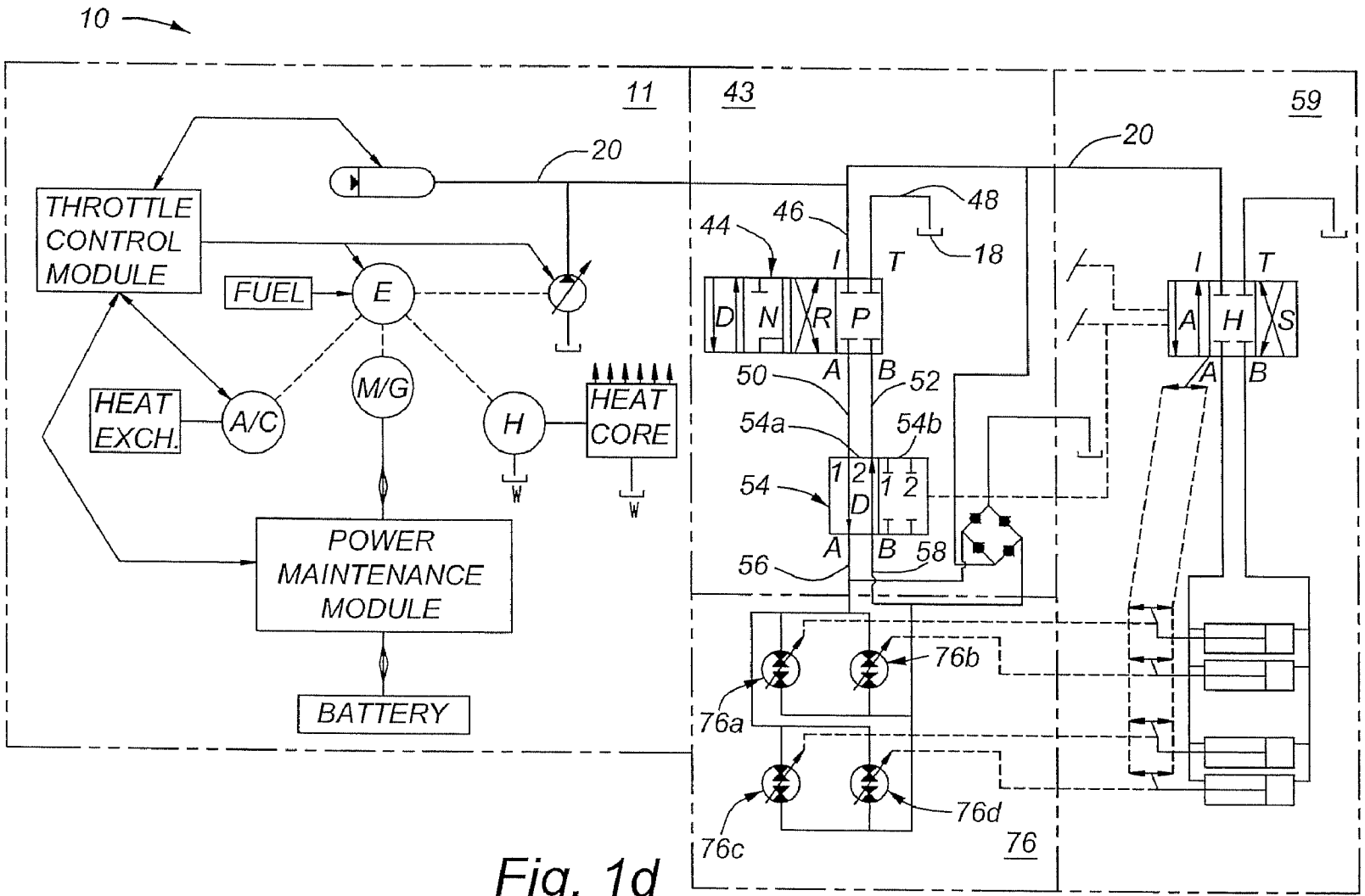
FIG. 1*d* is a view of the hydraulic hybrid powertrain system of FIG. 1*a* with the mode select valve in a "Park" position.
Figure 1E:
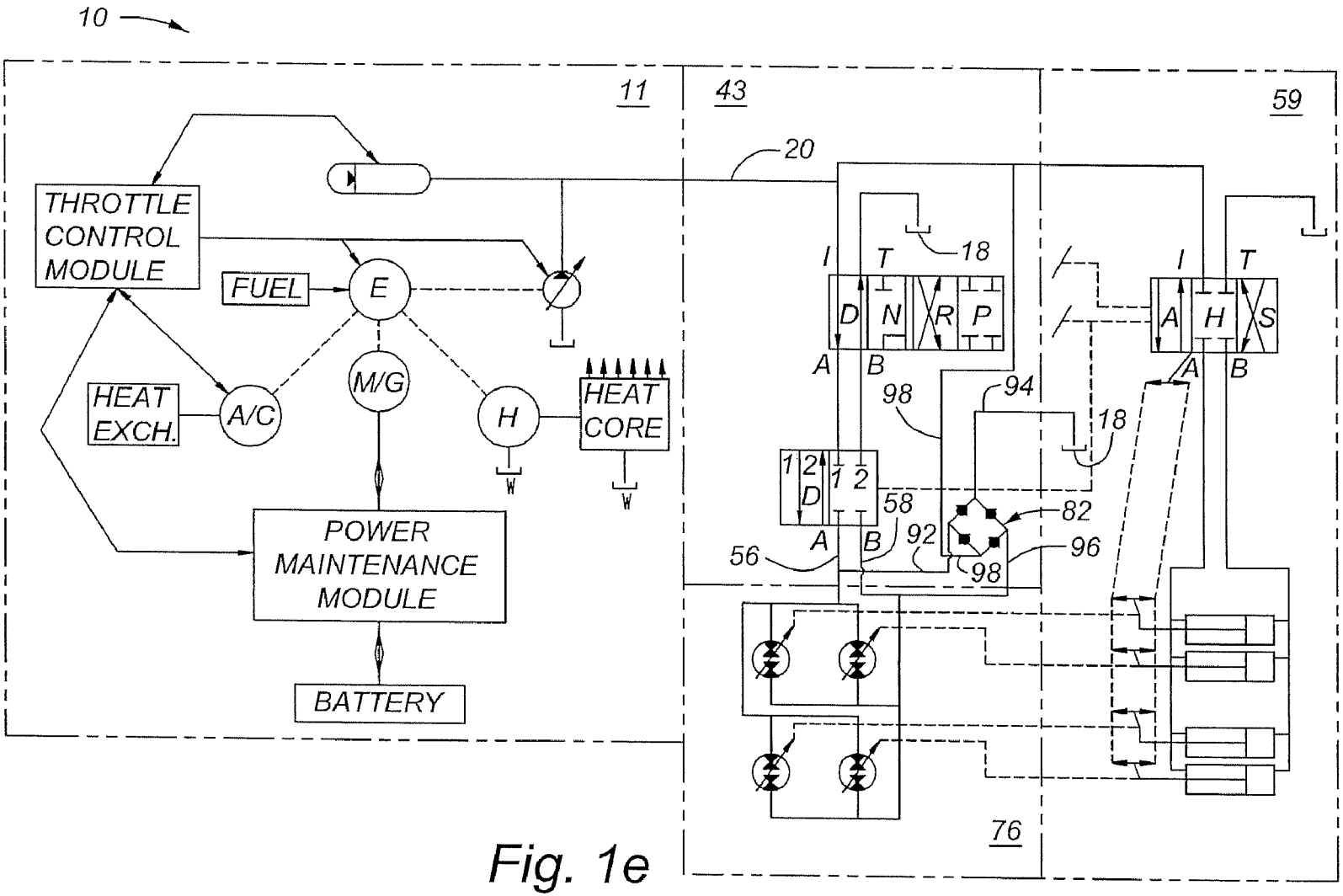
FIG. 1*e* is a view of the hydraulic hybrid powertrain system of FIG. 1*a* with a brake override device in an override position.

Referring to FIG. 1*d*, when the mode select valve 44 is in the P or park position, and the brake override device 54 is in the 54*a* position, hydraulic fluid will not flow through any of the conduits 46, 48, 50, and 52 as the caps adjacent each of the conduits 46, 48, 50, and 52 in the P position prevent any flow through to the motors 76*a*-76*d*.

As outlined above, in the first position 54*a*, the brake override device 54 allows hydraulic fluid to flow (depending on the position of the mode select valve 44) between the conduits 50 and 56, and between the conduits 52 and 58. In the second position 54*b*, however, best seen in FIG. 1*e*, hydraulic fluid will not flow through any of the conduits 50, 52, 56, and 58 as the caps adjacent each of the conduits 50, 52, 56, and 58 in the second position 54*b* prevent any flow through the brake override device 54. The brake override device 54 is moved from its normal first position 54*a* to the second position 54*b* by actuation of the brake 72 and the transmission of a signal along the connector 73 and prevents hydraulic fluid flow from the displacement control valve 44 to the motors 76*a*-76*d*.

In operation, if the brake 72 is engaged when the mode select valve 44 is in the D or drive position, and the override device 54 is moved to the second position 54*b*, the only source of hydraulic fluid for the motors 76*a*-76*d* is through the check valve bridge circuit 82 and, therefore, all fluid flow is routed through the check valve bridge circuit 82. During braking, the motors 76*a*-76*d* will begin to function as pumps, advantageously recapturing energy from the rotation of the vehicle wheels during braking. When braking in the D position, hydraulic fluid will flow from the hydraulic fluid source 18, through the conduit 94, through the check valve 86, through the conduit 92, to the upper ports 77-77*d* and to the motors 76*a*-76*d*, where the hydraulic fluid pressure is raised. High pressure hydraulic fluid will then flow from the motors 76*a*-76*d*, through the lower ports 78*a*-78*d*, through the conduit 96, and, if the pressure in the conduit 96 is greater than the conduit 98, through the check valve 90 and into the conduit 98, where the high pressure hydraulic fluid flows to the conduit 20 and recharges the accumulator 38.

When braking while the mode select valve 44 is in the R position, hydraulic fluid will flow from the hydraulic fluid source 18, through the conduit 94, through the check valve 88, through the conduit 96, to the lower ports 78*a*-78*d* and to the motors 76*a*-76*d*, where the hydraulic fluid pressure is raised. High pressure hydraulic fluid will then flow from the motors 76*a*-76*d*, through the upper ports 77*a*-77*d*, through the conduit 92, and, if the pressure in the conduit 92 is greater than the conduit 98, through the check valve 84 and into the conduit 98, where the high pressure hydraulic fluid flows to the conduit 20 and recharges the accumulator 38.

The check valve bridge circuit 82 functions to prevent flow of hydraulic fluid to the motors 76*a*-76*d* in a reverse direction once the vehicle has come to a complete stop. When braking and when the mode select valve 44 is in the D position, the brake override device 54 moves to the position 54*b* and prevents flow from the mode select valve 44 to the motors 76*a*-76*d*. Flow from the high pressure conduit 20 will attempt to reach the motors 76*a*-76*d* via the conduit 98 but is prevented from flowing to the motors via the check valves 84 and 90. The check valve bridge circuit 82 will allow flow to the conduit 98 only from the conduit 92 through the check valve 84 or from the conduit 96 via the check valve 90, which will only occur when the pressure in the conduits 56 and 92 or the conduits 58 and 96 are greater than the pressure in the conduit 98. If the pressure in the conduit 92 is less than the pressure in the conduit 98 and the conduit 94, the check valve 86 will open but since the conduit 94 is at a low pressure, no flow can occur from the reservoir 18 to the conduit 92. Similarly if the pressure in the conduit 96 is less than the pressure in the conduit 98 and the conduit 94, the check valve 88 will open but since the conduit 94 is at a low pressure, no flow can occur from the reservoir 18 to the conduit 96, and advantageously preventing high pressure hydraulic fluid from causing the motors 76*a*-76*d* to engage in a reverse direction after the vehicle has come to a complete stop.

In operation, the flow of the hydraulic fluid through the system 10 is controlled by the operator via the accelerator 70 and the brake 72 connected to the displacement control valve 60. The connector 80 and the connections 75*a*-75*d* are connected together via suitable linkage or the like, which allows the motors 76*a*-76*d* to provide feedback to the displacement control valve 60 via the connections 75*a*-75*d* in a similar manner as the connector 80 provides control to the motors 76*a*-76*d* through the connections 75*a*-75*d*.

For example, if a user (not shown) of the vehicle presses the accelerator 70, this causes the feedback connector 80 to move in an acceleration direction and causes the displacement control valve 60 to move toward the position 60*a*. High pressure fluid from the conduit 62 will flow through the ports on the displacement control valve 60, increasing the pressure in the conduit 66 and flowing to the cylinders 74*a*-74*d*. Since the pressure in the conduit 66 will be greater than the pressure in the conduit 68, the connectors 75*a*-75*d* will be moved in an acceleration direction, increasing the displacement and, therefore, the output torque of the motors 76*a*-76*d*.

Once a desired output torque of the motors 76*a*-76*d* has been reached, the motors 76*a*-76*d* will throttle back, moving the connectors 75*a*-75*d* in a deceleration direction, decreasing the pressure in the conduit 66 and increasing the pressure in the conduit 68. This movement is translated back to the displacement control valve 60 by the feedback connector 80, which moves the displacement control valve towards the position 60*b*. In the position 60*b*, there is no flow through the displacement control valve 60 and thus the connectors 75*a*-75*b* remain stationary and the displacement and, therefore, the output torque of the motors 76*a*-76*d* remains constant.

If the user removes his or her foot from the accelerator 70, this causes the feedback connector 80 to move in a deceleration direction and causes the displacement control valve 60 to move toward the position 60*c*. High pressure fluid from the conduit 62 will flow through the ports on the displacement control valve 60, increasing the pressure in the conduit 68 and flowing to the cylinders 74*a*-74*d*. Since the pressure in the conduit 68 will be greater than the pressure in the conduit 66, the connectors 75*a*-75*d* will be moved in an deceleration direction, decreasing the displacement and, therefore, the output torque of the motors 76*a*-76*d*.

Advantageously, there is no direct connection between the accelerator 70 and the engine 12. Rather, the engine 12 is operated and controlled based on a combination of engine speed (based on the signal on the line 42), torque (based on the position of the displacement control valve 60, which is affected by the position of the accelerator 70), and system pressure (based on the signal on the line 38*a*). This combination of inputs allows the throttle control module 40 of the system 10 to always run the engine 12 at its peak efficiency, based on known engine efficiency parameters and, therefore, provide proportional control of the engine 12 and system 10. At times when the system 10 is fully charged, the engine 12 can be advantageously turned off, reducing the instant fuel consumption to zero. When the system pressure drops, the engine 12 is restarted to again provide pressure to the conduit 20.

Based on the condition or operating state of the air conditioning compressor 24, the power maintenance module 28, and the accumulator 38 (as determined by their respective signals on the lines 24*a*, 28*a*, and 38*a*), the throttle control module 40 sends a signal on the line 42 to start or stop the engine 12 and/or vary the displacement of the pump/motor 16.

As the system pressure in the conduit 20 increases, the accumulator 38 fills and the rate of flow from the pump/motor 16 is reduced. The flow of the pump/motor 16 continues to be reduced until the system pressure drops due to an output to the motors 76*a*-76*d*. If at any time the flow of the pump/motor 16 reaches zero flow, the engine 12 may be turned off until flow is again needed. The flow of the pump/motor 16 may also be reduced if an accessory requires power to prevent the engine 12 from stalling (assuming the accessory is clutched to the engine 12). The powertrain system 10 obtains its efficiency by averaging the rate of power consumption. Energy needed for intermittent bursts is supplied by the stored energy in the accumulator 38. The pump/motor 16 provides flow greater than the average flow needed to propel the vehicle. The extra flow created by the pump 16 is then stored in the accumulator 38.

The hydraulic hybrid powertrain system 10 in accordance with the present invention advantageously providing an uncomplicated and straightforward control methodology and a very responsive control means for the system 10 by virtue of the fact that output torque response from the motors 76*a*-76*d*, once their displacement is increased, is very quick.

Those skilled in the art will appreciate that the system 10 in accordance with the present invention may be utilized to supply hydraulic power to any number of systems including, but not limited to, a propulsion system for a floating or submersible vessel such as a ship, a boat, or a submarine, a propulsion system for a helicopter, among others. In short, the output of the pump/motor 16 could be utilized with the powertrain system 10 to run any number of hydraulic motors, such as the motors 76*a*-76*d* for any number of purposes while remaining with the scope of the present invention.

The connectors 73, 75*a*-75*d*, and 80, and the signals on the lines 24*a*, 28*a*, 38*a*, and 42 may be any type of mechanical connector, such as a hydraulic line, a cable, a metal bar or the like, or an electrical signal communicating with solenoid valves or the like, while remaining within the scope of the present invention.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A pump gear set comprising;

a drive gear having a plurality of drive gear teeth; and an idle gear having a plurality of idle gear teeth for meshing with said drive gear teeth, wherein said gears mesh initially at a first of two mesh points and subsequently at a second of said mesh points along corresponding tooth profiles of one of said drive gear teeth and one of said idle gear teeth to provide a sealing area between said gears while engaged at said first and second mesh points for trapping fluid in said sealing area, wherein said one of said drive gear teeth and said one of said idle gear teeth do not mesh at more than two points at a time during rotation of said gears, wherein said first mesh point includes a root of said one drive gear tooth and a tip of said one idle gear tooth.

2. The pump gear set of claim 1 wherein said second mesh point is positioned along a side of said one drive gear tooth and a facing side of said one idle gear tooth.

3. The pump gear set of claim 2 wherein said sealing area allows fluid to hydrostatically escape from said sealing area when said first mesh point becomes disengaged.

4. A low noise gear set for use with a power plant comprising:

an engine driving a pump connected to a low pressure fluid source to generate high pressure fluid at an output;

at least one variable displacement pump/motor responsive to said high pressure fluid for generating rotary motion at an output;

said displacement pump/motor comprising:

a drive gear having a plurality of teeth; and an idle gear having a plurality of teeth for meshing with said drive gear teeth, wherein said gears initially mesh at a first mesh point along a profile of each of said gears to fluid seal from said low pressure fluid source, subsequently mesh at a second mesh point along said profiles before disengaging at said first mesh point to form a sealing area between said first and second mesh points trapping fluid in said sealing area, and allow said trapped fluid to hydrostatically escape to said high pressure fluid output from said sealing area upon disengaging at said first mesh point, wherein said gears do not mesh at more than two points at a time during rotation of said gears, wherein one of said first and second mesh points includes a root of one of said profiles and a tip of another of said profiles and another of said first and second mesh points is along a side of one of said profiles and along a facing side of another of said profiles for forming said sealing area.

5. The low noise gear set of claim 4 wherein said sealing area allows said trapped fluid to hydrostatically escape as each associated pair of drive gear teeth and idle gear teeth become disengaged during rotation of said gears.

6. A gear set for reducing wear by forcing a hydrostatic bearing between contact surfaces of a pair of gears comprising:

a pair of gears, each said gear having a plurality of teeth with a corresponding tooth profile wherein during meshing of said gears, said tooth profiles sequentially engage at two spaced apart mesh points forming a sealing area between said gears trapping fluid that acts as a hydrostatic bearing between opposed surfaces of said gears, wherein said gears do not mesh at more than two points at a time during rotation of said gears, wherein one of said mesh points includes a root of one of said teeth and a tip of another of said teeth.

7. The gear set of claim 6 wherein another of said mesh points is along a side of one of said tooth profiles and along a side of another of said tooth profiles.

8. The gear set of claim 7 wherein said sealing area allows said trapped fluid to hydrostatically escape when said gear teeth become disengaged at a fist of said mesh points to engage.

9. A method for providing a low noise gear pump while reducing gear wear comprising the steps of:

a. providing a first gear having a plurality of teeth and a second gear having a plurality of teeth;

b. engaging the first gear with the second gear at a first mesh point including a root of one of the gear teeth and a tip of another of the gear teeth;

c. subsequently engaging the first gear with the second gear at a second mesh point including a side of the one gear tooth and a side of the another gear tooth to form a sealing area trapping fluid between the first and second mesh points; and d. disengaging the gear teeth at the first mesh point thereby allowing the trapped fluid to hydrostatically escape from the sealing area, wherein said gear teeth do not mesh at more than two points at a time during rotation of said first and second gears, wherein one of said mesh points includes a root of one of said teeth and a tip of another of said teeth.

* * * * *